US005267583A

United States Patent [19]

Wu

[11] Patent Number: 5,267,583

[45] Date of Patent: Dec. 7, 1993

[54] MULTIPLE-FOLD AUTOMATIC UMBRELLA CONTROLLED BY SINGLE PUSH BUTTON

[76] Inventor: Woh-Wen Wu, P. O. Box 55-1670, Taipei, Taiwan

[21] Appl. No.: 860,089

[22] Filed: Mar. 30, 1992

[51] Int. Cl.[5] ..... A45B 25/14

[52] U.S. Cl. ..... 135/24; 135/22; 135/23; 135/25.1; 135/20.3

[58] Field of Search ..... 135/24, 23, 22, 20.3, 135/25.1

[56] References Cited

U.S. PATENT DOCUMENTS

| | | | |
|---|---|---|---|
| 1,091,895 | 3/1914 | Schaaf | 135/24 X |
| 3,003,508 | 10/1961 | Bremshey | 135/24 |
| 3,672,382 | 6/1972 | Sato | 135/24 |
| 3,756,258 | 9/1973 | Yoshihara | 135/24 X |
| 4,534,374 | 8/1985 | Day | 135/22 |
| 4,823,821 | 4/1989 | Day | 135/22 X |
| 4,936,332 | 6/1990 | Wu | 135/24 X |
| 4,941,494 | 7/1990 | Wu | 135/24 X |
| 4,986,294 | 1/1991 | Wu | 135/24 X |
| 5,060,684 | 10/1991 | Wu | 135/24 X |
| 5,078,165 | 1/1992 | Wu | 135/24 |
| 5,125,426 | 6/1992 | Wu et al. | 135/24 X |
| 5,144,969 | 9/1992 | Chou et al. | 135/24 X |
| 5,161,562 | 10/1992 | Wu | 135/20.3 |
| 5,178,174 | 1/1993 | Wu | 135/24 X |

*Primary Examiner*—Carl D. Friedman
*Assistant Examiner*—Robert Canfield

[57] ABSTRACT

An automatic umbrella with multiple folds particularly of triple folds includes: a central shaft device having an upper, a middle, and a lower tubular shaft telescopically engageable with one another and having a grip formed on a lower portion of the central shaft device, a controller formed in the grip for controlling an opening or closing of the umbrella, a rib assembly pivotally secured to the central shaft device for supporting an umbrella cloth on the rib assembly, an extending spring retained within the central shaft device for extending the shaft and the umbrella when opening the umbrella, and a plurality of retraction restoring springs secured on the rib assembly for retracting the rib assembly for closing the umbrella, in which the extending spring is jacketed on an upper sleeve fixed in the upper tubular shaft and jacketed in a middle sleeve secured on the middle tubular shaft of the central shaft device so as to prevent any frictional contacting of the coiled extending spring with an inside wall of the central shaft device for noise prevention and for a smooth opening and closing operation of the umbrella having multiple folds.

1 Claim, 5 Drawing Sheets

MULTIPLE-FOLD AUTOMATIC UMBRELLA CONTROLLED BY SINGLE PUSH BUTTON

BACKGROUND OF THE INVENTION

U.S. Pat. No. 5,078,165 patented on: Jan. 2, 1992 entitled: "Automatic Umbrella Opened and Closed by a Straightforward Push Button" invented by T. Z. Wu discloses a strightforward single push button 51 for controlling the opening and closing of the umbrella, which however may still have the following drawbacks:

1. The extending spring 3 is telescopically operated within the lower tubular shaft 11 and the upper tubular shaft 14 having a diameter larger than that of the lower shaft 11 so that there will have a large aperture between the coil spring 3 and an inside wall of the upper shaft 14. The spring 3 reciprocating within the aperture in the upper shaft 14 will exert noise due to a frictional contacting between the spring coils and the upper shaft 14.

2. Even a lower flange 143 is formed on the upper shaft 14 slidably held on the lower shaft 11 will bias the two helical springs 531*a* sidewardly as shown in FIG. 8 of prior art to form an aperture D between the two separated springs 531*a*, which aperture D is greater than a width W of the push button 51 so that during the depression of the push button 51 to open the umbrella, the inward movement of the button 51 will not depress the two springs 531*a* to prevent a false actuation of the closing controller 53 to ensure the locking of the locking head 536 by the retarding plate 533 of the closing controller 53.

However, if the push button 51 is further deeply depressed inwardly, the two springs 531*a* may still be touched and depressed to falsely actuate the closing controller 53 to unexpectedly accidentally close an opened umbrella.

The present inventor has found the drawbacks of the conventional prior art and invented the present automatic umbrella of multiple folds for improvig the shortcomings of the prior art.

SUMMARY OF THE INVENTION

The object of the present invention is to provide an automatic umbrella with multiple folds particularly of triple folds including: a central shaft device having an upper, a middle, and a lower tubular shaft telescopically engageable with one another and having a grip formed on a lower portion of the central shaft device, a controller formed in the grip for controlling an opening or closing of the umbrella, a rib assembly pivotally secured to the central shaft device for supporting an umbrella cloth on the rib assembly, an extending spring retained within the central shaft device for extending the shaft and the umbrella when opening the umbrella, and a plurality of retraction restoring springs secured on the rib assembly for retracting the rib assembly for closing the umbrella, in which the extending spring is jacketed on an upper sleeve fixed in the upper tubular shaft, and jacketed in a middle sleeve secured on the middle tubular shaft of the central shaft device so as to prevent any frictional contacting of the coiled extending spring with an inside wall of the central shaft device for noise prevention and for a smooth opening and closing operation of the umbrella having multiple folds.

DETAILED DESCRIPTION

Figure 1:
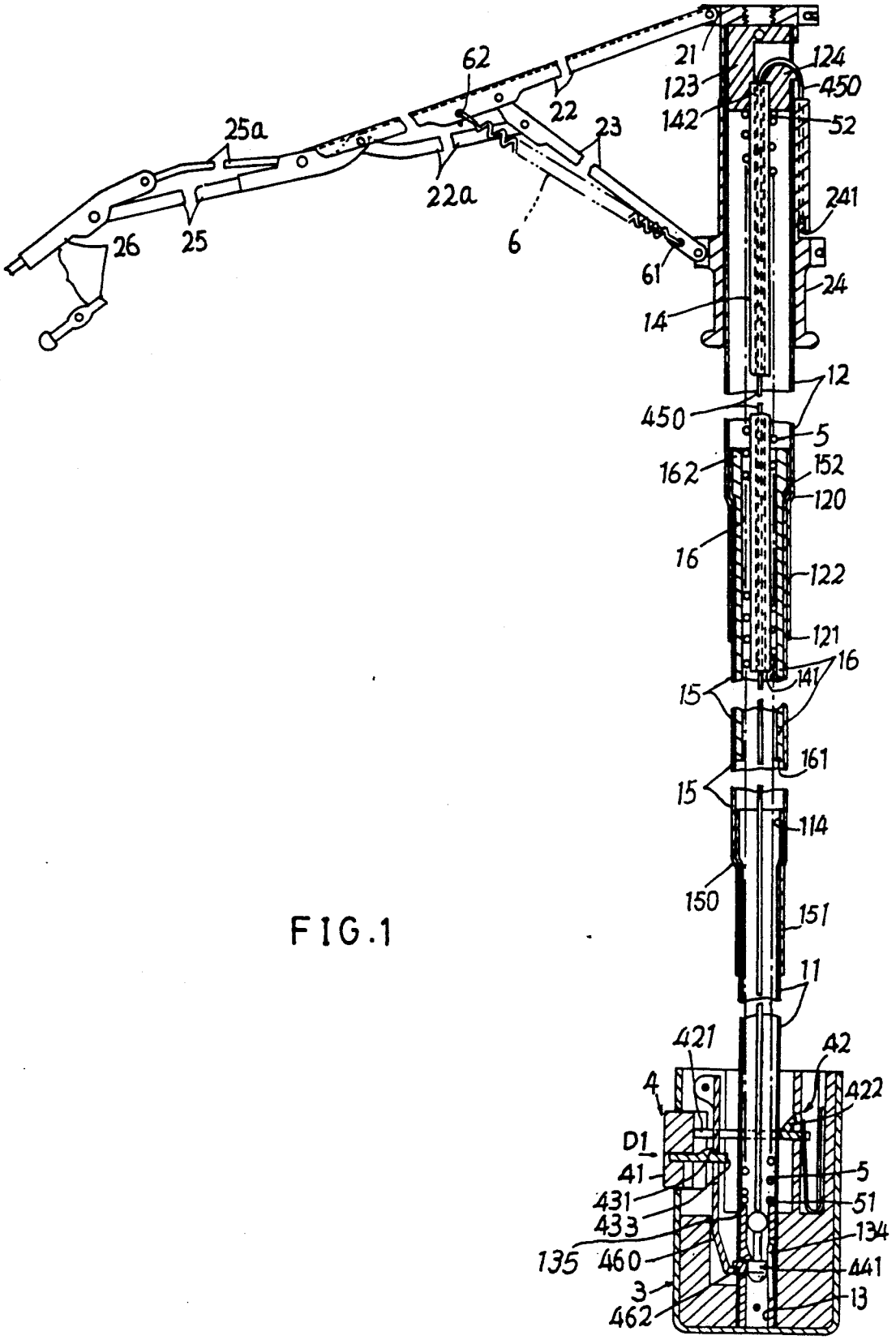
FIG. 1 is an illustration showing an opened umbrella of the present invention.

As shown in FIGS. 1–7, the present invention comprises: a central shaft means 1, a rib assembly 2 for securing an umbrella cloth or canopy (not shown) on the rib assembly 2, a grip 3, a control means 4, an extending spring 5, and a plurality of retraction restoring springs 6.

Figure 3:
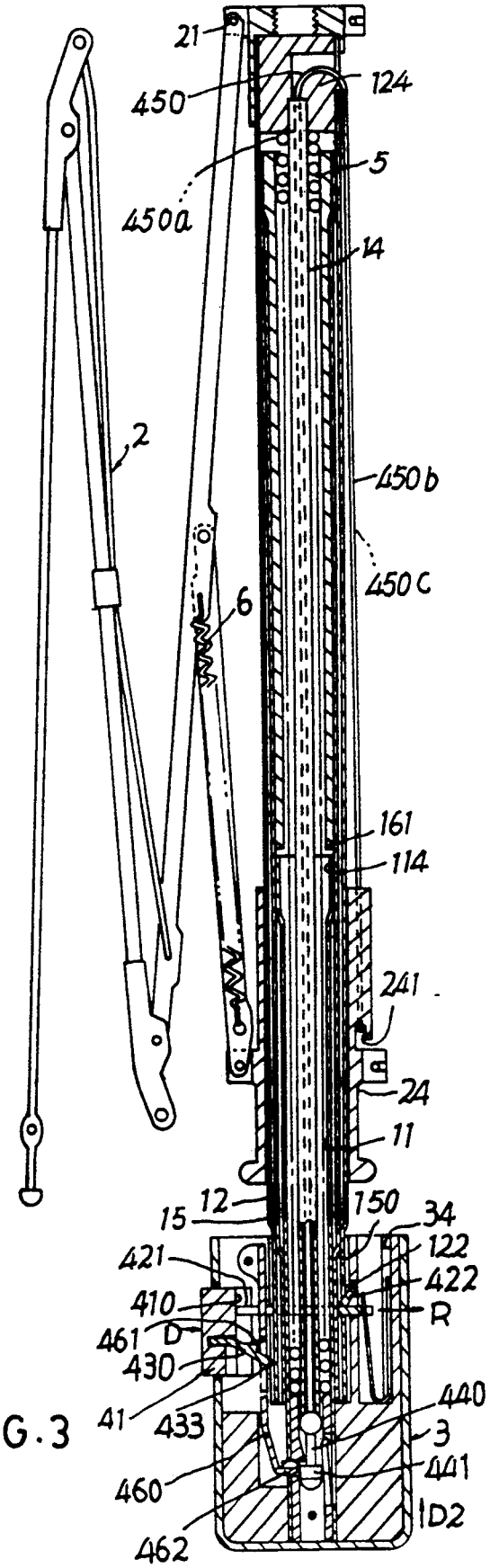
FIG. 3 shows a folded umbrella when depressing a grip of the present invention as shown in FIG. 2.

The central shaft means 1 includes; a lower tubular shaft 11 having a lower end portion 111 fixed in the grip 3 having a rod hole 112 formed in the lower end portion 111 at a first side 3*a* of the grip 3 and an upper enlarged portion 114 formed on an upper portion of the lower shaft 11; a middle tubular shaft 15 slidably engageable with the lower shaft 11 having a lower end portion 151 tapered downwardly from a contraction portion 150 formed on a lower portion of the middle shaft 15 with the contraction portion 150 operatively coupled with the upper enlarged portion 114 of the lower shaft 11 and having an upper enlarged portion 152 formed on an upper portion of the middle shaft 15; an upper tubular shaft 12 slidably engageable with the middle tubular shaft 15 having a contraction portion 120 formed on a lower portion of the upper shaft 12 to be operatively coupled with the upper enlarged portion 152 of the middle shaft 15, a lower end portion 121 tapered downwardly from the contraction portion 120 of the upper shaft 12, an engaging hole 122 formed in the lower end portion 121 of the upper shaft 12 at a second side 3*b* of the grip 3, and an upper inner block 123 formed in an upper end portion of the upper shaft 12 having a sliding groove 124 recessed in the inner block 123 (which may also be modified to be a roller pivotally mounted on the upper shaft 12); a lower sleeve 13 fixed in the grip 3 within the lower shaft 11 having a triangular block portion 131 formed in the lower sleeve 13 inclined inwardly downwardly, an inner rod hole 132 formed in the lower sleeve 13 positioned below the triangular block portion 131 adjacent to the rod hole 112 and to a bottom portion of the grip 3 at a first side 3*a* of the grip 3, and an upper sleeve end portion 135 formed on an upper portion of the lower sleeve 13; an upper sleeve 14 having a lower sleeve end portion 141 protruding into the middle shaft 15 when opening the umbrella and having an upper sleeve end portion 142 fixed in the inner block 123 of the upper shaft 12 with the extending spring 5 jacketed on the upper sleeve 14 to be slidably engageable with the upper sleeve 14 to prevent tangling of the spring coil of the extending spring 5, thereby reducing a frictional contacting between the spring 5 and an inside wall of the upper shaft 12 and the middle shaft 15 for noise prevention; and a middle sleeve 16 having a lower sleeve end portion 161 operatively approximating the upper enlarged portion 114 of the lower shaft 11 when closing the umbrella as shown in FIG. 3 and an upper sleeve end portion 162 secured in the upper enlarged portion 152 of the middle shaft 15 for slidably holding the extending spring 5 in between the middle sleeve 16 and the upper sleeve 14 for reducing a frictional contacting between the spring 5 and the middle and lower shafts 15, 11 for preventing noise.

The middle and lower shafts 15, 11 may have their lower shaft portions insertably retracted into a central hole 30 of the grip 3.

The rib assembly 2 may be similar to a conventional rib assembly and includes: an upper notch 21 secured on a top portion of the upper shaft 12, a plurality of top ribs 22 pivotally secured to the upper notch 21, a plurality of stretcher ribs 23 pivotally secured to a lower runner 24 slidably held on the middle and upper shafts 15, 12, a plurality of middle ribs 25 pivotally connected to the top ribs 22, a plurality of outer ribs 26 each having its inner end portion of the outer rib 26 pivotally secured to an outer end portion of each middle rib 25 and an outer end portion of a resilient rib 25*a*, and a plurality of connection ribs 22*a* each having its inner end portion pivotally secured to an outer end portion of each stretcher rib 23 and having an outer end portion of the connection rib 22*a* pivotally secured to the middle rib 25 and the resilient rib 25*a*. The top rib 22 has its middle portion pivotally secured with an outer end portion of the stretcher rib 23.

Each retraction restoring spring 6 has an inner spring end portion 61 secured to an inner end portion of the stretcher rib 23 and an outer spring end portion 62 secured to the top rib 22 adjacent to a joint pivotally connecting the top rib 22 with the stretcher rib 23. Each retraction restoring spring 6 is preferably positioned to be adjacent to a side surface portion of each respective rib pivotally connected with the retraction restoring spring 6 for helpfully folding the umbrella to be a compact unit.

The extending spring 5 has its lower spring end portion 51 retained on the upper sleeve portion 135 of the lower sleeve 13 and an upper spring end portion 52 retained on the inner block 123 of the upper shaft 12.

The lower shaft 11 has a cross section of hexagonal shape for storing the extending spring 5 therein; the middle shaft 15 being made as a circular tube having a lower tube portion made as hexagonal shape to be engageable with the lower shaft 11; and the upper shaft 12 made as hexagonal shape having a lower tube portion made as circular shape to be engageable with the circular middle shaft 15.

The control means 4 includes: a push button 41, an opening controller 42, and a closing controller 43.

The push button 41 includes: a shoulder portion 413 slidably held in a button hole 31 formed in the grip 3 at the first side 3*a* of the grip 3 and limited by an outer jacket 33 surrounding the grip 3, and a pushing rod socket 411 recessed in an inside button surface 410 of the push button 41.

The opening controller 42 includes: a pair of bifurcated members 421 bifurcated frontwardly towards the first side 3*a* of the grip 3 and slidably held in a middle transverse hole 32 formed in a central portion of the grip 3 to be normally contacting with the inside button surface 410 of the push button 41 and slidably disposing about an outer circumferential surface of the upper shaft 12, a wedge portion 422 tapered downwardly inwardly towards a center of the central shaft means 1 and secured to each rear portion of the bifurcated members 421, and a controller restoring spring 423 held in a spring socket 34 formed in the grip 3 at the second side 3*b* of the grip 3 for urging the wedge portion 422 through the middle transverse hole 32 to be engaged with the engaging hole 122 of the upper shaft 12 when closing the umbrella, and also for urging the bifurcated members 421 frontwardly to protrude the push button 41 outwardly ready for a depression operation.

Figure 4:
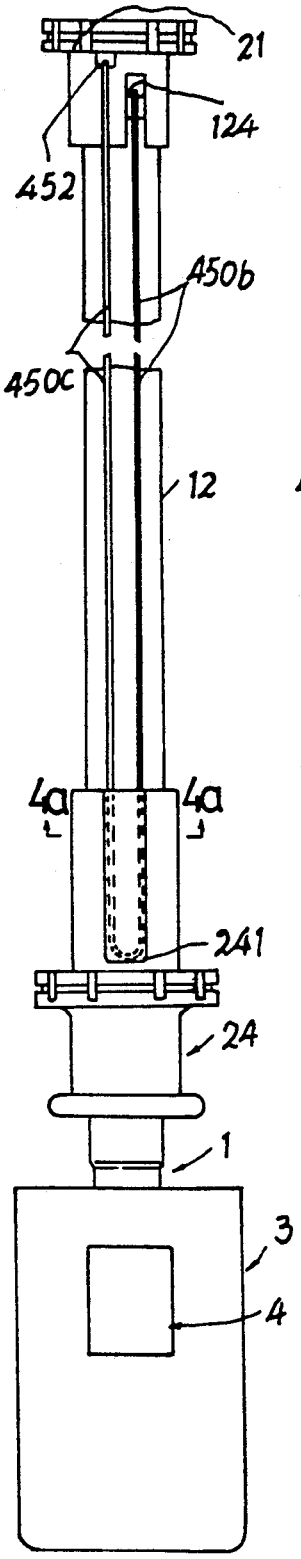
FIG. 4 is an illustration showing a rope of the present invention.
Figure 4A:
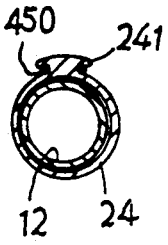
FIG. 4A is a cross sectional drawing of a lower runner of the present invention.
Figure 5:
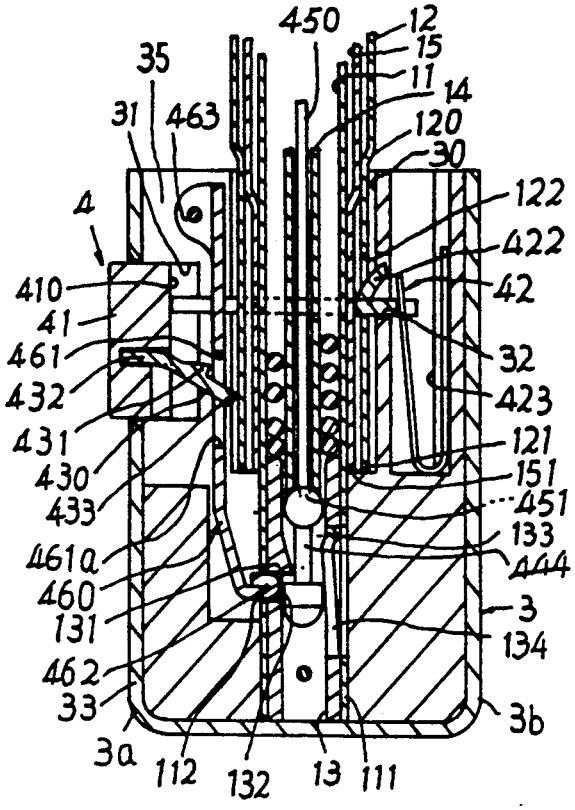
FIG. 5 is a sectional drawing of the present invention when viewed at the grip of the umbrella.
Figure 7:
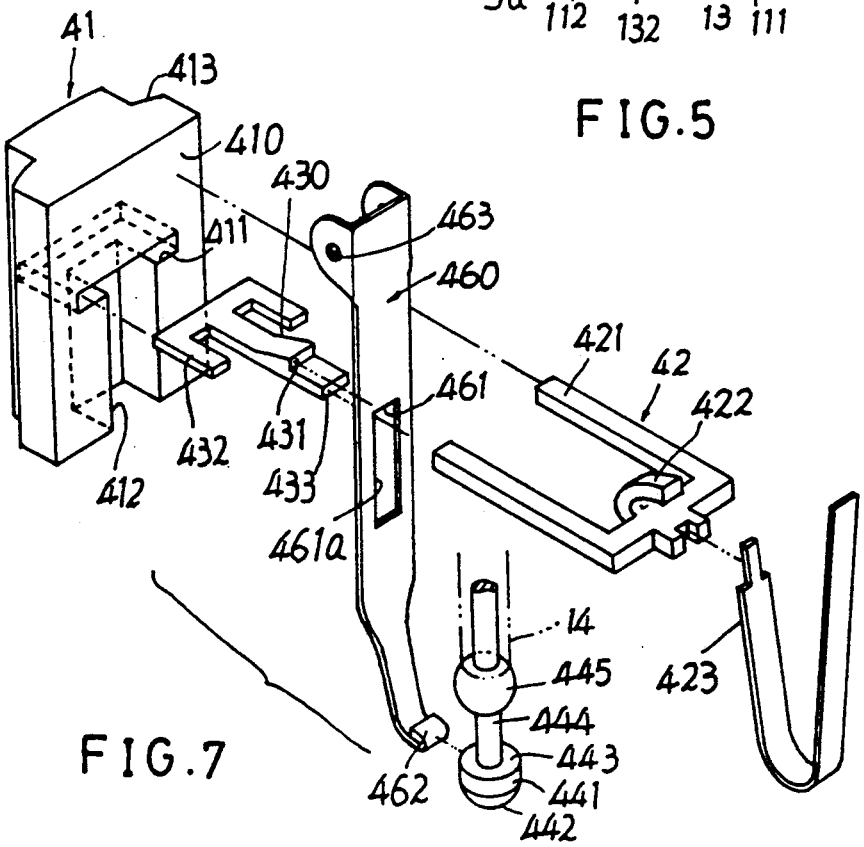
FIG. 7 is a perspective view of a controller of the present invention.
Figure 6:
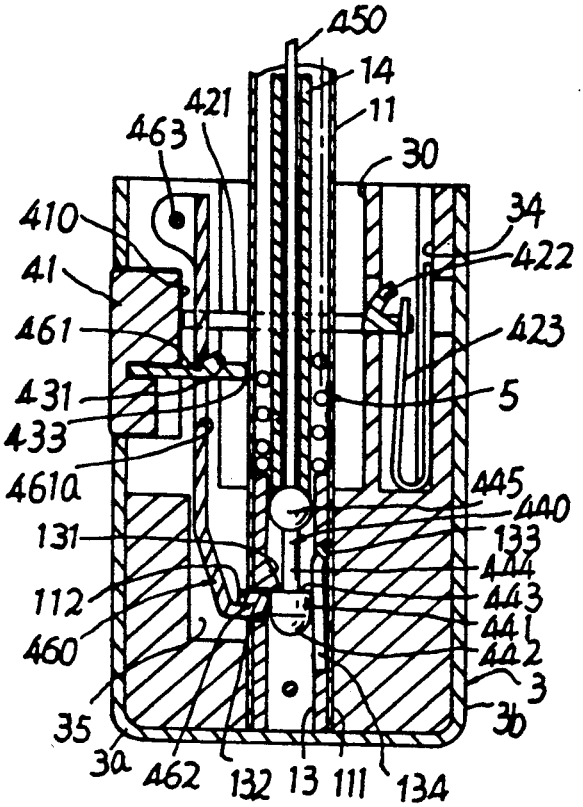
FIG. 6 shows a sectional drawing of the present invention when depressing a closing controller of the umbrella.

The closing controller 43 includes: an elastic pushing rod 430 made of elastic material having a pushing rod portion 433 normally protruding horizontally rearwardly towards the second side 3*b* of the grip having a triangular block portion 431 inclined frontwardly downwardly towards the first side 3*a* of the grip to be operatively depressed downwardly by the lower end portion 121 of the upper shaft 12 when closing the umbrella as shown in FIGS. 5, 3, and a holding portion 432 which is embedded in the pushing rod socket 411 recessed in the push button 41; a biasing lever 460 with a pin 463 pivotally securing an upper portion of the biasing lever 460 in a lever socket 35 of the grip 3, an elongate slot 461*a* longitudinally formed in a middle portion of the biasing lever 460 having an upper edge portion 461 engageable with the triangular block portion 431 of the pushing rod 430 for an inward or rearward depression of the lever 460 by the pushing rod 430 when opening the umbrella as shown in FIG. 1, and an actuating head portion 462 formed on a lower end portion of the biasing lever 460; a locking head means 440 having a locking head portion 441 formed with an arcuate bottom portion 442 on a bottom portion of the locking head portion 441 and a locking shoulder portion 443 on an upper portion of the locking head portion 441, and a universal ball 445 secured with the locking head portion 441 with a neck portion 444 between the ball 445 and the locking head portion 441; and a rope 450 having a lower rope end portion 451 secured with the universal ball 445 of the locking head means 440 and having an upper rope end portion 452 secured to the upper notch 21 by passing the rope 450 through a central portion of the shaft means 1, the upper sleeve 14 and deflectively winding the rope 450 on the upper sliding groove 124 formed on the inner block 123 downwardly to the lower runner 24 and then deflectively winding the rope upwardly through a lower sliding groove 241 formed on the lower runner 24 to be upwardly extended to the upper notch 21 as shown in FIGS. 3, 4. The locking head portion 441 provided with the arcuate bottom portion 442 may be universally held on a lower sleeve end 141 when lowered in the lower sleeve 13 when folding the umbrella will be biased by the triangular block portion 131 (serving as a retarding block portion) to push a resilient plate 134 cut from a cut-out hole 133 on the sleeve 13 rearwardly from a center of the shaft means 1 until being engaged and locked by the triangular block portion 131; or the locking head portion 441 may be disengaged from the triangular block portion 131 when thrusted by the actuating head portion 462 of the elastic pushing rod 430 as shown in FIG. 2.

As shown in FIGS. 3, 5, for opening the umbrella of the present invention, the push button 41 is depressed in direction D (FIG. 3) to urge the bifurcated members 421 rearwardly to retract te wedge portion 422 in direction R to disengage the engaging hole 122 of the upper shaft 12, and the extending spring 5 will urge the upper shaft 12 upwardly to pull the middle shaft 15 upwardly since the contraction portion 120 of the upper shaft 12 is engageable with the upper enlarged portion 152 of the middle shaft 15, until the lower contraction portion 150 of the middle shaft 14 engages the upper enlarged portion 114 of the lower shaft 11. The rib assembly 2 and the umbrella cloth are also extended to open the umbrella as shown in FIG. 1. Meanwhile, the lower runner 24 is slid upwardly along the central shaft means 1 to thereby tension the rope 450 among the upper notch 21, the lower runner 24 and the locking head means 440, of which the locking head portion 441 is engaged and locked at the triangular block portion 131 of the lower sleeve 13. Each retraction restoring spring 6 is tensioned when opening the umbrella for storing a potential restoring elastic energy of the spring 6, ready for a restoring retraction of the ribs 2 for lowering the lower runner 24 for folding or closing the umbrella. However, the lowering of the runner 24 by each retraction restoring spring 6 will pull the rope 450 which is locked by the locking head portion 441 engaged by the block portion 131 and therefore, the retraction restoring spring 6 can not be effected to close the umbrella, and the umbrella is opened by the extending spring 5 for extending the tubular shafts 12, 15, 11, the ribs 2 and the umbrella cloth.

During the opening operation of the umbrella from FIGS. 3 and 5 to FIG. 1, a user's finger has depressed the push button 41 in direction D so that the triangular block portion 431 of the push rod portion 433, which is previously bent downwardly by the lower end portion 121 of the upper shaft 12 when closing the umbrella to be disengaged from the upper edge portion 461 of the biasing lever 460, will be poked rearwardly, without being obstructed by the upper edge portion 461 of the biasing lever 460, thereby being impossible to inwardly push the biasing lever 460 of the closing controller 43, for preventing an unexpected accidental closing of an opened umbrella. The push button 41 is then released ready for next depression operation.

Figure 2:
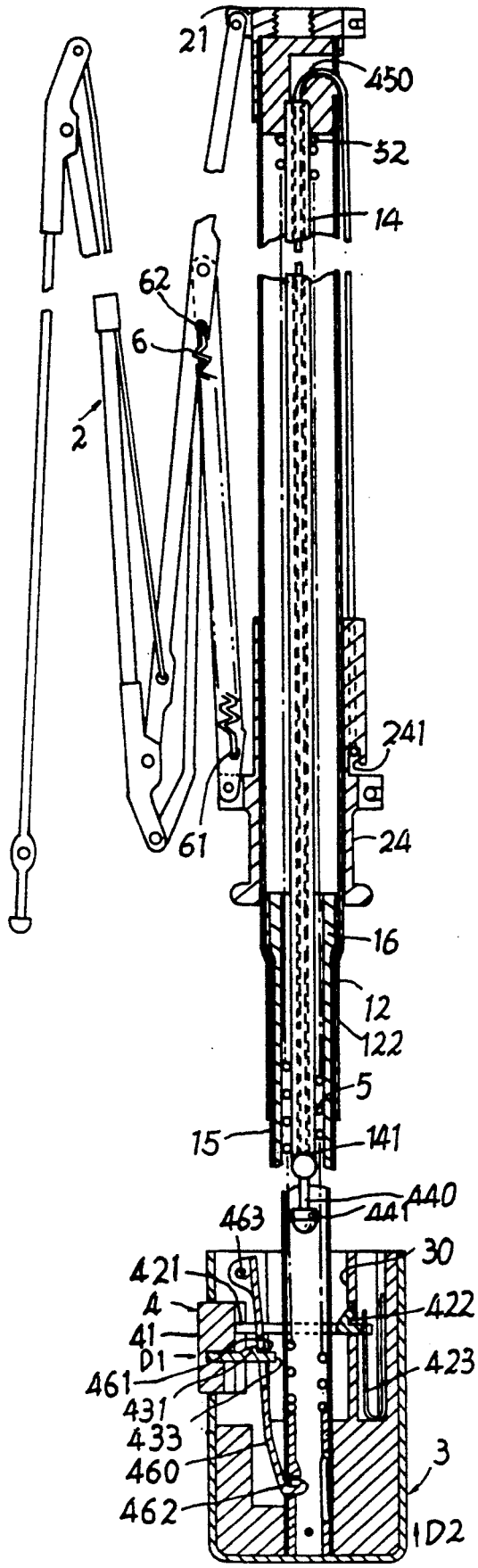
FIG. 2 shows a closed umbrella in accordance with the present invention.

When closing the umbrella from an opened state as shown in FIG. 1, the push button 41 is depressed in direction D1 (FIG. 1, 2) to allow the triangular block portion 431 of the pushing rod portion 433, which is engaged with the upper edge 461 of the slot **461*a* of the biasing lever 460, to push the lever 460 rearwardly towards the second side 3*b* of the grip 3 to allow the actuating head portion 462 to disengage the locking head portion 441 from the triangular block portion 131 of the lower sleeve 13, thereby effecting the retraction restoring springs 6 for lowering the runner 24 and retracting the ribs 2 for closing the umbrella as shown in FIG. 2. The rope 450 is simultaneously pulled to raise the universal ball 455 to be retained on the lower sleeve end portion 141 of the upper sleeve 14**.

The grip 3 is depressed in direction D2 for resetting and compressing the extending spring 5 from FIG. 2 to FIG. 3 to fold the tubular shafts 12, 15, 11 to allow the inner block 123 of the upper shaft 12 to depress the upper end portion 152 of the middle shaft downwardly 15 and also lower the upper shaft 12 to insert the lower portions 121, 151 of the upper, middle shafts 12, 15 into the central hole 30 of the grip 3 to retract the wedge portion 422 until engaging the wedge portion 422 with the engaging hole 122 of the upper shaft 12, thereby finally folding the upper, middle and lower shafts 12, 15, 11 at a closed state of the umbrella.

When closing the umbrella for storing the elastic energy of the extending spring 5, the upper sleeve 14 secured to the upper shaft 12 will depress the locking head means 440 downwardly to allow the locking head portion 441 to pass and then engage the triangular block portion 131 to position the locking head portion 441 to face the rod holes 132, 112 of the lower sleeve 13 and the lower shaft 11 and to face the actuating head portion 462 of the biasing lever 460 ready for a next depression of the pushing rod portion 433 for disengaging the locking head portion 441 from the block 131 for closing an opened umbrella.

The present invention is superior to a conventional automatic umbrella of the U.S. Pat. No. 5,078,165 with the following advantages:

1. By providing the sleeves 14, 16 inside the shaft means 1 for reducing or preventing a frictional contacting of the extending spring 5 with an inside wall of the shaft means 1 for noise reduction or prevention, also for a smooth folding or extending operation of the shaft means 1.

2. The rope 450 is continuously connected between the locking head means 440 and the upper notch 21 through the lower runner 24, without the aid of any coupling or connector in the rope for simplifying the assembly of the umbrella of this invention. The rope 450 is generally folded with triple folds from its extended state to be in commensuration with the three tubular shafts 12, 15, 11 which may be extended to increase a total length of the shaft means 1 for a convenient and ergonomic handling of the umbrella.

3. The actuating head portion 462 of the biasing lever 460 of the control means 4 is protruded downwardly below a lower portion of the push button 41 and the lower end portions 121, 151 of th upper and middle shafts 12, 15 are deeply protruded into the grip 3 through hole 30, and the lower sleeve 13 is shorten to thereby "prolong" the extending spring 5 into the grip portion for saving a depression force for resetting the spring 5 from FIG. 2 to FIG. 3 whenever depressing the grip 3 according to Hooke's law.

4. The retraction restoring spring 6 is provided on a side portion of the rib 2 to reduce a folding volume of the umbrella, beneficial for portable purpose.

5. The single push button of this invention may prevent a false unexpected operation such as an unexpected closing from an opened umbrella.

I claim:

1. An automatic umbrella comprising:

a central shaft means having an upper tubular shaft slidably telescopically engageable with an extendibly positioned above a middle tubular shaft, said middle tubular shaft telescopically engageable with the extendibly positioned above a lower tubular shaft, said lower tubular shaft secured on a grip, said lower tubular shaft having a lower end portion fixed in the grip having a rod hole formed in the lower end portion at a first side of the grip and an upper enlarged portion formed on an upper portion of the lower shaft, said middle tubular shaft slidably engageable with the lower shaft having a lower end portion tapered downwardly from a contraction portion formed on a lower portion of the middle shaft with the contraction portion operatively coupled with the upper enlarged portion of the lower shaft and having an upper enlarged portion formed on an upper portion of the middle shaft, said upper tubular shaft slidably engageable with the middle tubular shaft having a contraction portion formed on a lower portion of the upper shaft to be operatively coupled with the upper enlarged portion of the middle shaft, a lower end portion tapered downwardly from the contraction portion of the upper shaft, an engaging hole formed in the lower end portion of the upper shaft at a second side of the grip, and an inner block formed in an upper end portion of the upper shaft having a sliding groove recessed in the inner block, a lower sleeve fixed in the grip within the lower shaft having a triangular block portion formed in the lower sleeve inclined inwardly downwardly, and an inner rod hole formed in the lower sleeve positioned below the triangular block portion adjacent to the rod hole formed in the lower end portion of the lower tubular shaft and to a bottom portion of the grip at a first side of the grip, an upper sleeve having a lower sleeve end portion protruding into the middle shaft when opening the umbrella and having an upper sleeve end portion of said upper sleeve fixed in the inner block of the upper shaft with an extending spring jacketed on the upper sleeve for preventing noise caused by a frictional contacting between the spring and an inside wall of the upper shaft and the middle shaft, and a middle sleeve having a lower end portion operatively approximating the upper enlarged portion of the lower shaft when closing the umbrella and an upper sleeve end portion of said middle sleeve secured in the upper enlarged portion of the middle shaft for preventing a noise caused by a frictional contacting between the spring and the middle and lower shafts;

a rib assembly having at least a top rib pivotally secured to an upper notch fixed on a top portion of said upper shaft, and a stretcher rib pivotally secured with said top rib and pivotally secured to a lower runner slidably held on said central shaft means;

said extending spring retained in between said upper shaft and said lower sleeve secured in the lower shaft in said grip for operatively opening the umbrella, said extending spring jacketed on said upper sleeve secured in said upper shaft and disposed in said middle sleeve secured in said middle shaft, and said upper sleeve protruding downwardly into said middle sleeve secured in said middle shaft defining an aperture between said upper and middle sleeves for slidably holding said extending spring in said aperture for reducing a frictional contacting between said extending spring and an inside wall of each said upper and middle shaft of said shaft means for noise prevention;

a plurality of retraction restoring springs each said retraction restoring spring retained on a side portion of said rib assembly for operatively closing the umbrella from an opened state of the umbrella; and a control means for operatively opening the umbrella from a closed state of the umbrella, and for operatively closing the umbrella from an opened state thereof, said control means including: a push button having a shoulder portion slidably held in a button hole formed in the grip at the first side of the grip and limited by an outer jacket surrounding the grip, and a pushing rod socket recessed in an inside button surface of the push button; an opening controller having a pair of bifurcated members bifurcated frontwardly towards the first side of the grip and slidably held in a middle transverse hole formed in a central portion of the grip to be normally contacting with the inside button surface of the push button and slidably disposing about an outer circumferential surface of the upper shaft, a wedge portion tapered downwardly inwardly towards a center of the central shaft means and secured to a rear portion of the bifurcated members, and a controller restoring spring held in a spring socket formed in the grip at the second side of the grip for urging the wedge portion through the middle transverse hole to be engaged with the engaging hole of the upper shaft when closing the umbrella, and also for urging the bifurcated members frontwardly to protrude the push button outwardly ready for a depression operation; a closing controller having an elastic pushing rod made of elastic material having a pushing rod portion normally protruding horizontally rearwardly towards the second side of the grip having a triangular block portion inclined frontwardly downwardly towards the first side of the grip to be operatively depressed downwardly by the lower end portion of the upper shaft when closing the umbrella, and a holding portion which is embedded in the pushing rod socket recessed in the push button; a biasing lever with a pin pivotally securing an upper portion of the biasing lever in a lever socket of the grip, an elongate slot longitudinally formed in a middle portion of the biasing lever having an upper edge portion engageable with the triangular block portion of the pushing rod for an inward or rearward depression of the lever by the pushing rod, and an actuating head portion formed on a lower end portion of the biasing lever; a locking head means having a locking head portion formed with an arcuate bottom portion on a bottom portion of the locking head portion and a locking shoulder portion on an upper portion of the locking head portion, and a universal ball secured with the locking head portion with a neck portion between the ball and the locking head portion; and a rope having a lower rope end portion secured with the universal ball of the locking head means and having an upper rope end portion secured to the upper notch by passing the rope through a central portion of the shaft means, the upper sleeve and deflectively winding the rope on the upper sliding groove formed on the inner block downwardly to the lower runner and then deflectively winding the rope upwardly through a lower sliding groove formed on the lower runner to be upwardly extended to the upper notch, said locking head portion provided with the arcuate bottom portion univerally held on a lower sleeve end when lowered in the lower sleeve when folding the umbrella being biased by the triangular block portion of the lower sleeve to push a resilient plate rearwardly from a center of the shaft means until being engaged and locked by the triangular block portion of the lower sleeve; or the locking head portion being disengaged from the triangular block portion of the lower sleeve when thrusted by the actuating head portion of the elastic pushing rod.

* * * * *